US005488979A

United States Patent [19]

McKenzie

[11] Patent Number: 5,488,979

[45] Date of Patent: Feb. 6, 1996

[54] CLEAN SPOUT FUNNEL AND SLEEVE THEREFOR

[76] Inventor: Jimmy B. McKenzie, Rte. 6, Box 277, Clinton, N.C. 28328

[21] Appl. No.: 386,340

[22] Filed: Feb. 10, 1995

Related U.S. Application Data

[63] Continuation of Ser. No. 179,373, Jan. 10, 1994, abandoned.

[51] Int. Cl.[6] ..... B65B 39/00

[52] U.S. Cl. ..... 141/331; 141/337; 141/339; 141/311 A

[58] Field of Search ..... 141/98, 86, 88, 141/311 A, 331–340, 341, 342, 364; 222/460, 562, 544, 545; 150/154, 165; 206/216, 349; 383/36

[56] References Cited

U.S. PATENT DOCUMENTS

| | | | |
|---|---|---|---|
| 1,320,649 | 11/1919 | Pound | 141/337 |
| 2,443,848 | 6/1948 | Boeringer | 141/331 X |
| 3,016,173 | 1/1962 | Stull | 222/562 |
| 3,490,501 | 1/1970 | Manem et al. | 141/331 X |
| 3,899,012 | 8/1975 | Sather | 141/331 |
| 4,335,730 | 6/1982 | Griffin . | |
| 4,429,788 | 2/1984 | Harris | 206/349 |
| 4,531,295 | 7/1985 | Lowd et al. | 141/337 X |
| 4,600,125 | 7/1986 | Maynard, Jr. | 222/81 |
| 4,706,719 | 11/1987 | Eversdijk | 141/337 X |
| 4,706,720 | 11/1987 | Pattison et al. | 141/327 |
| 4,789,017 | 12/1988 | Panasewicz et al. | 141/339 X |
| 4,832,238 | 5/1989 | Taylor | 141/337 X |
| 4,834,261 | 5/1989 | Brdlik | 220/404 |
| 4,921,147 | 5/1990 | Poierier | 141/337 X |
| 4,970,817 | 11/1990 | Mansfield | 141/340 |
| 5,020,702 | 6/1991 | James | 141/337 |
| 5,080,149 | 1/1992 | Peoples | 141/337 |
| 5,121,859 | 6/1992 | Stull | 222/562 |
| 5,123,461 | 6/1992 | Belokin, Jr. et al. | 141/98 |

*Primary Examiner*—Henry J. Recla
*Assistant Examiner*—Steven O. Douglas
*Attorney, Agent, or Firm*—Jacobson, Price, Holman & Stern

[57] ABSTRACT

A funnel and a sleeve for covering all or substantially all of the funnel's pouring spout. The funnel includes a progressively narrowing top portion having a broad intake end and a narrow discharge end with a pouring spout connected thereto. The sleeve is adapted to receive the pouring spout and preferably securely engages the narrow discharge end of the funnel's top portion. Once the pouring spout is received inside the sleeve, the interior and exterior surface areas of the spout are protected from contamination. Preferably, the funnel further comprises a cap for securely engaging and covering the broad intake end of the funnel. This cap serves to keep contaminants out of the internal surface areas of the progressively narrowing portion of the funnel. For added protection, the sleeve can further comprise a netting material or bag which is mounted circumferentially around the sleeve and has dimensions sufficiently large enough that netting material or bag can be drawn over and around the progressively narrowing top portion to thereby protect the top portion from contaminants. This way, both the inside and outside surface areas of the funnel are protected from contaminants.

17 Claims, 6 Drawing Sheets

CLEAN SPOUT FUNNEL AND SLEEVE THEREFOR

This is a continuation of application Ser. No. 08/179,373, filed Jan. 1, 1994 which was abandoned upon the filing hereof.

BACKGROUND OF THE INVENTION

The present invention relates to a funnel with a progressively narrowing top portion and a spout, and further comprising a sleeve for covering the spout to prevent dirt, dust or other contaminants from collecting on the inside and outside surfaces of the spout. According to a preferred embodiment, the sleeve further comprises a bag or netting which can be drawn over the progressively narrowing top portion to prevent contaminants from collecting thereon.

The use of funnels is well known, especially in the field of automotive mechanics. Funnels are frequently used to pour motor oil or transmission fluid through small openings in the valve cover or transmission dip stick tube, respectively, of an automobile. In doing so, the spout of the conventional funnel is inserted into the respective opening and often comes into contact with internal surfaces of the engine or transmission. Since it is very important that these internal surfaces be maintained free from contaminants, such as dirt, metal filings, or other abrasive particles typically found in an automotive repair shop, it is very important that both the inside and outside surfaces of the spout also be maintained free from such contaminants.

In a typical automotive shop, a funnel can be found either lying on the floor of the shop, or hung on a wall, rack or above a trash can. In all of these places, the funnel easily becomes contaminated with abrasive particles. These abrasive particles are not easily removed because they tend to stick to oily residues which are left on the funnel itself. Nevertheless, the contaminants must be wiped away carefully whenever the funnel is used to pour fluids into an automotive or hydraulic component.

Several prior art funnels are disclosed in U.S. Pat. Nos. 3,889,012 to Sather; 4,335,730 to Griffin; 4,834,261 to Brdlik; 4,600,125 to Maynard, Jr.; 4,706,720 to Pattison; 5,080,149 to Peoples; and 5,123,461 to Belokin, Jr. et al.

The patent to Sather discloses a funnel having a pouring spout which is flexible with a cap being mounted in spaced relation to the free end of the pouring spout for snap engagement with the large end of the funnel thus protecting the entire internal surface area of the funnel and pouring spout, and a portion of the external surface of the poetring spout as illustrated in FIG. 2 of the patent. The cap 27 illustrated in FIG. 4 is slidably mounted on the pouring spout to enable the nozzle of the pouring spout to be inserted into inaccessible filler openings.

The patent to Maynard discloses a funnel structure with detachable and interchangeable pouring spouts secured in place by a threaded connection. In this structure, if the pouring spout extension is placed over the pouring spout that is a part of the primary funnel, and the plug is used, then the external surface of the pouring spout would be covered and remain clean. However, this is not the purpose nor intent of the structure in Maynard since the pouring spout extensions 14 and 15 are actually intended to be used as pouring spouts and no protective sleeve is provided for the pouring spout extensions.

The other patents disclose various funnels and associated tubular sleeves and the like but none of the disclosed arrangements relate to solving the problem of eliminating contamination of the external surface of the pouring spout of a funnel.

SUMMARY OF THE INVENTION

A primary object of the present invention is to solve the foregoing problems associated with the prior art, by providing a funnel with a sleeve for covering the funnel's spout to thereby prevent dirt, dust or other contaminants from collecting on the inside and outside surfaces of the spout.

Another object of the present invention is to prevent contamination of the entire inside and outside surface areas of the funnel by providing a sleeve which covers the spout of the funnel and a bag or netting connected to the sleeve which can be drawn over a progressively narrowing top portion of the funnel.

To achieve these and other objects, the present invention comprises a funnel and a sleeve for covering all or substantially all of the funnel's pouring spout. The funnel itself includes a progressively narrowing top portion having a broad intake end and a narrow discharge end. The pouring spout is connected to, or formed integrally with, the narrow discharge end of the top portion.

The sleeve is adapted to receive the pouring spout and preferably includes means for securely engaging the narrow discharge end of the funnel's top portion. Once the pouring spout is received inside the sleeve, the interior and exterior surface areas of the spout are protected from contamination.

Preferably, the means for securely engaging the narrow discharge end of the funnel's top portion, comprise threads circumferentially surrounding the narrow discharge end and corresponding threads at an open end of the sleeve.

Alternatively, the means for securely engaging the narrow discharge end can comprise a projection located at the narrow discharge end, which projection engages a groove in the sleeve, or a groove in the narrow discharge end which engages a projection on the sleeve. In either case, the sleeve is snapped into engagement with the funnel so that the pouring spout is contained within the sleeve.

A handle can be provided on the funnel to facilitate handling thereof. The handle also provides means for balancing the funnel or for hanging the funnel in a shop or on a piece of machinery.

Preferably, the funnel further comprises a cap for securely engaging and covering the broad intake end of the funnel. This cap serves to keep contaminants out of the internal surface areas of the progressively narrowing portion of the funnel. The cap can be entirely removable from the funnel, or alternatively, can be attached thereto by an attachment means to prevent loss of the cap when it is not covering the broad intake end.

For added protection, the sleeve can further comprise a netting material or bag which is mounted circumferentially around the sleeve and has dimensions sufficiently large enough that the netting material or bag can be drawn over and around the progressively narrowing top portion to thereby protect the top portion from contaminants. This way, both the inside and outside surface areas of the entire funnel are protected from contaminants.

Preferably, the netting material further comprises a drawing means so that the netting material can be drawn tightly around the progressively narrowing top portion. Illustrative examples of such drawing means include a draw string, an elastic band, or a hook-and-loop fastener.

The netting material, alternatively, can be mounted to the cap or to the broad intake end of the progressively narrowing portion. This netting material or bag is then connected circumferentially around the sleeve, or alternatively, drawn around the spout and sleeve so as to protect the exterior of the progressively narrowing portion from contaminants. In the latter case, the exterior of the sleeve is also protected.

According to a preferred embodiment of the present invention, the pouring spout of the funnel includes a flexible portion which permits bending of the spout.

The above and other objects and advantages will become more readily apparent when reference is made to the following description taken in conjunction with the accompanying drawings.

DETAILED DESCRIPTION OF THE PREFERRED EMBODIMENTS

Figure 1:
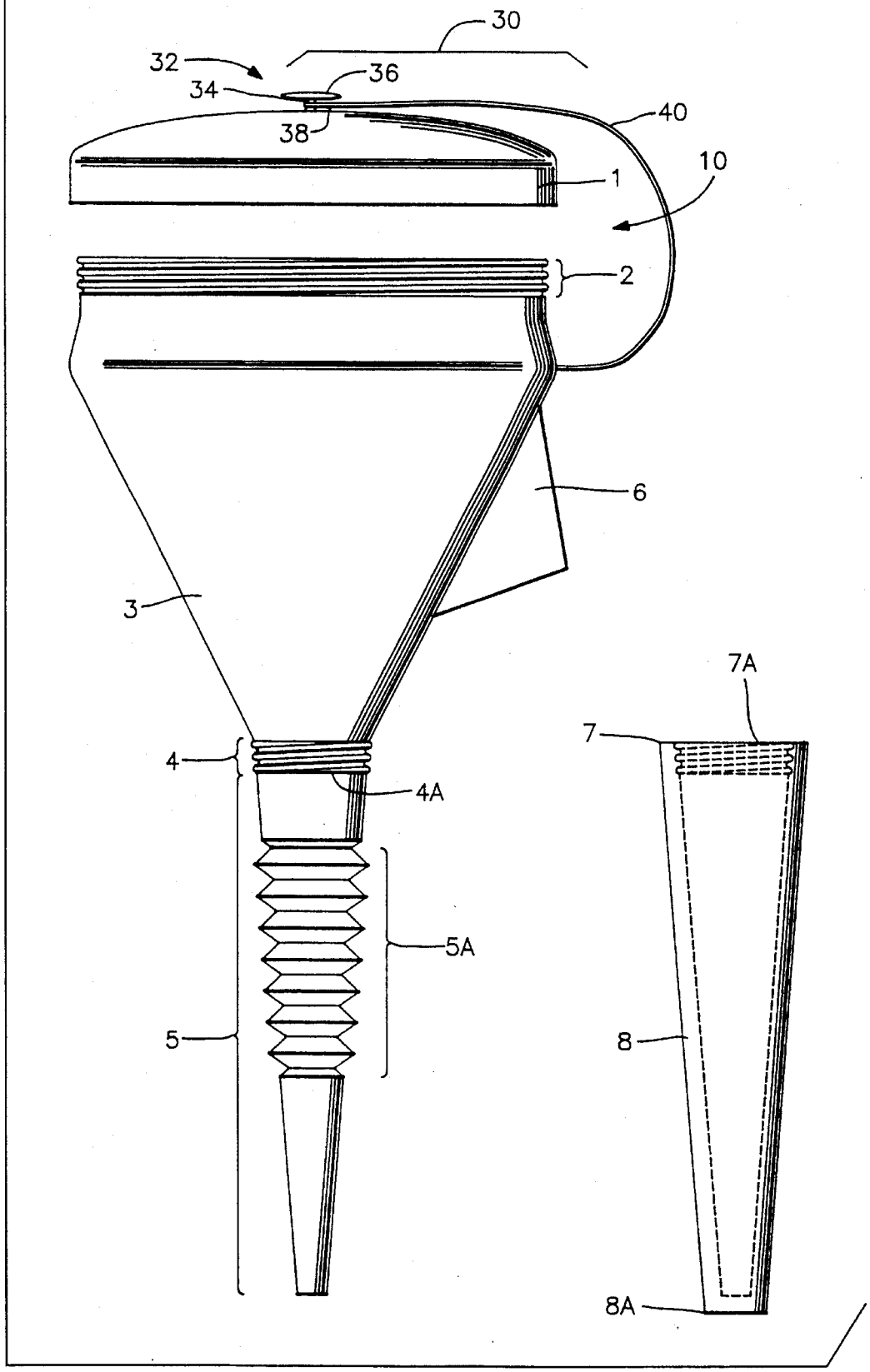
FIG. 1 illustrates a preferred embodiment of the present invention wherein the sleeve is removed from the pouring spout so that the funnel can be used.
Figure 2:
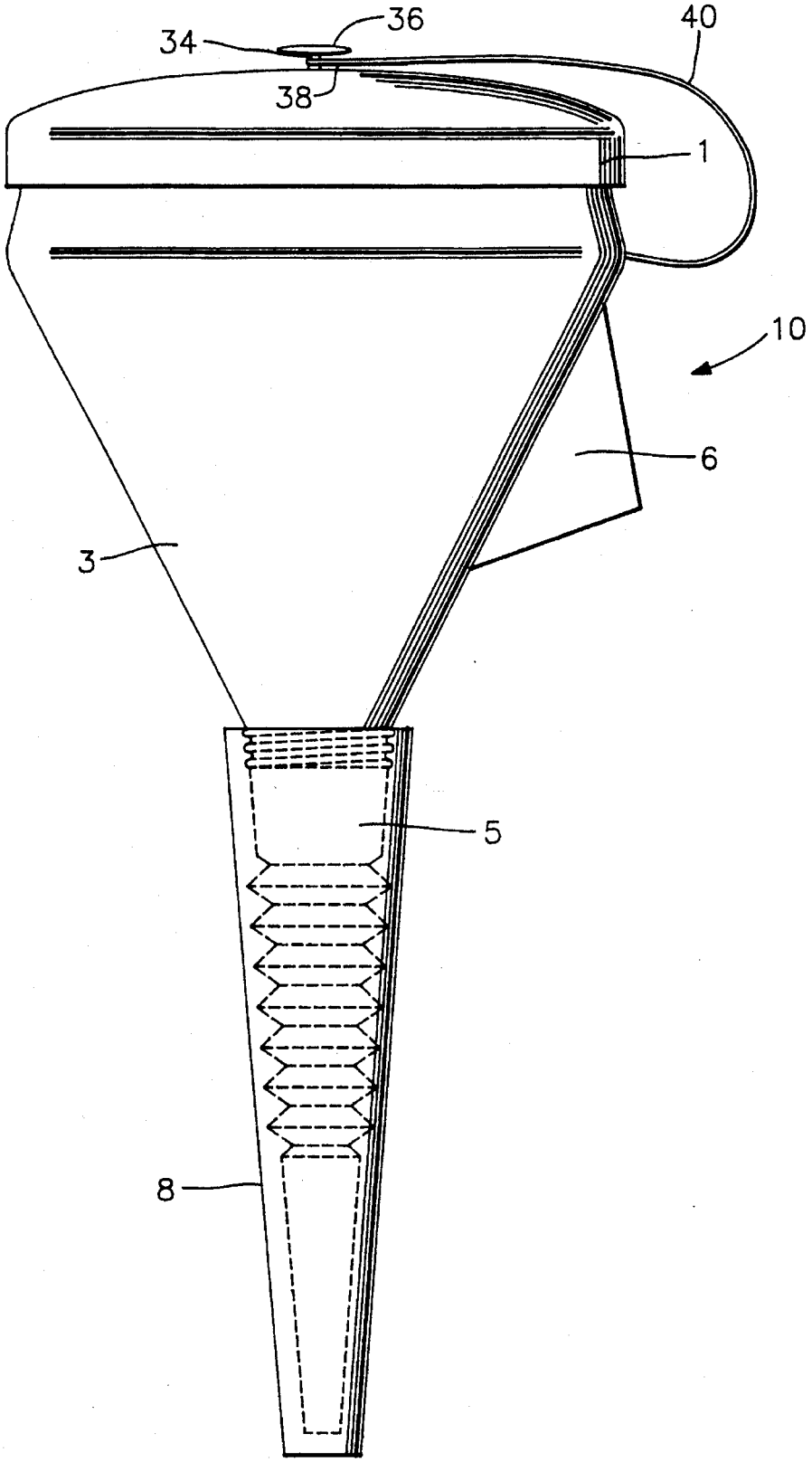
FIG. 2 illustrates the embodiment of FIG. 1, but where the pouring spout is received within the sleeve so that the pouring spout is protected from contaminants.

With reference to FIGS. 1 and 2, a preferred embodiment of the present invention will now be described.

The funnel 10 of the preferred embodiment comprises a cap 1; a broad intake end 2; a progressively narrowing top portion 3; a narrow discharge end 4 of the progressively narrowing top portion 3; and a pouring spout 5 connected to, or integrally formed with, the narrow discharge end 4.

Preferably, the pouring spout 5 includes a flexible portion 5A which permits bending of the pouring spout 5.

In order to cover the pouring spout 5 of the funnel 10 such that the exterior and interior surface areas of the pouring spout 5 are protected from contaminants, a sleeve 8 is provided. The sleeve 8 comprises a closed distal end 8A, an open proximal end 7 and a substantially tubular body adapted to receive the pouring spout 5 of the funnel 10.

Preferably, means are provided at the open proximal end 7 for securely connecting the sleeve 8 to the narrow discharge end 4 of the funnel 10 while the pouring spout 5 is contained within the sleeve 8. Once the pouring spout 5 is received within the sleeve 8, as illustrated in FIG. 2, the interior and exterior surface areas of the spout 5 are protected from contamination.

As shown in FIG. 1, the means for securely engaging the narrow discharge end 4 preferably comprise threads 4A circumferentially surrounding the narrow discharge end 4 and corresponding threads 7A at the open proximal end 7 of the sleeve 8.

Figure 3:
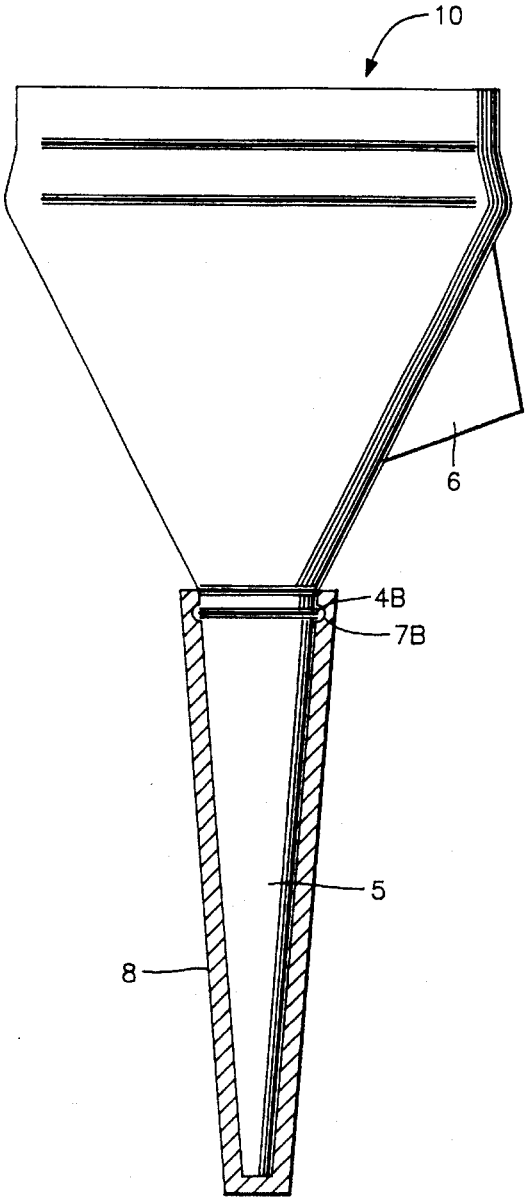
FIGS. 3 and 4 are cross sections of alternative embodiments of the present invention wherein grooves and projections are provided for securing the sleeve to the funnel.
Figure 4:
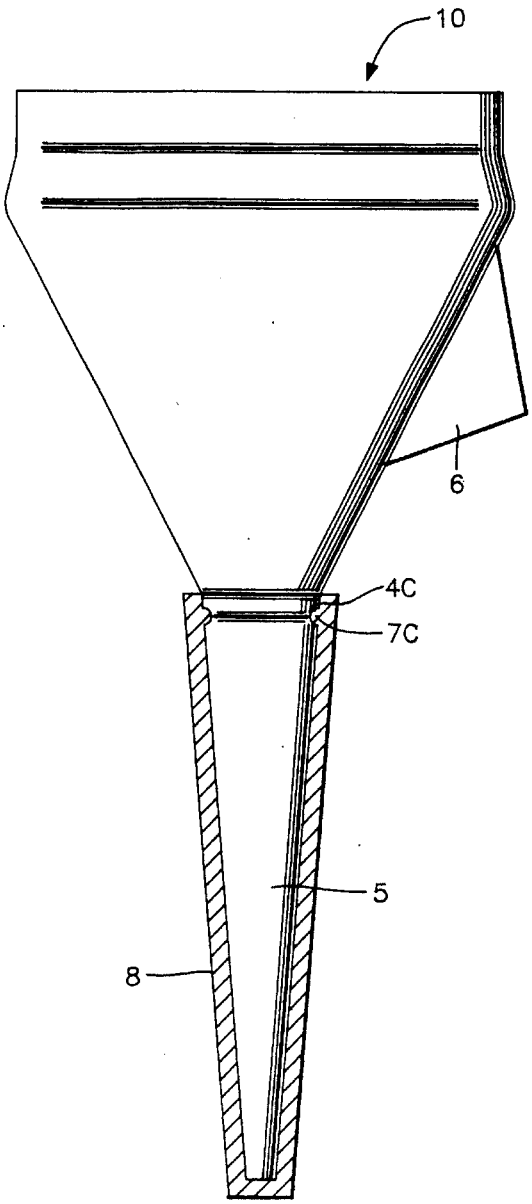

Alternatively, with reference to FIG. 3, the means for securely engaging the narrow discharge end 4 can comprise a projection 4B located at the narrow discharge end 4, which projection 4B engages a groove 7B in the sleeve 8. Similarly, with reference to FIG. 4, a groove 4C can be provided in the narrow discharge end 4, which engages a projection 7C on the inside surface of the sleeve 8. In either case, the sleeve 8 is snapped into engagement with the funnel 10 so that the pouring spout 5 is contained within the sleeve 8.

With reference to FIGS. 1–4, the funnel 10 preferably includes a handle 6 to facilitate handling of the funnel 10. The handle 6 also provides means for balancing the funnel 10 or for hanging the funnel 10 in a shop or on a piece of machinery.

The cap 1 at the broad intake end 2 is preferably threaded thereto, and serves to keep contaminants out of the internal surface areas of the progressively narrowing portion 3 of the funnel 10. The cap 1 can be entirely removable from the funnel 10, or alternatively, can be attached thereto by an attachment means 30 to prevent loss of the cap 1 when it is not covering the broad intake end 2.

The attachment means 30 preferably includes a projection 32 at the top of the cap 1, which projection 32 has a shank 34 and a head 36 having a larger diameter than the shank 34. An eyelet 38 is rotatably secured around the shank 34 and has a smaller diameter than the head 36 to thereby prevent detachment of the eyelet 38 from the projection 32. A strap 40 then connects the eyelet 38 to the funnel 10. Because the eyelet 38 remains free to rotate about the shank 34, the cap 1 can be readily unscrewed from broad intake end 2 without completely removing and potentially misplacing the cap 1. Although the attachment means 30 is illustrated only in FIGS. 1 and 2, it is understood that the attachment means 30 is compatible with other embodiments.

Figure 5:
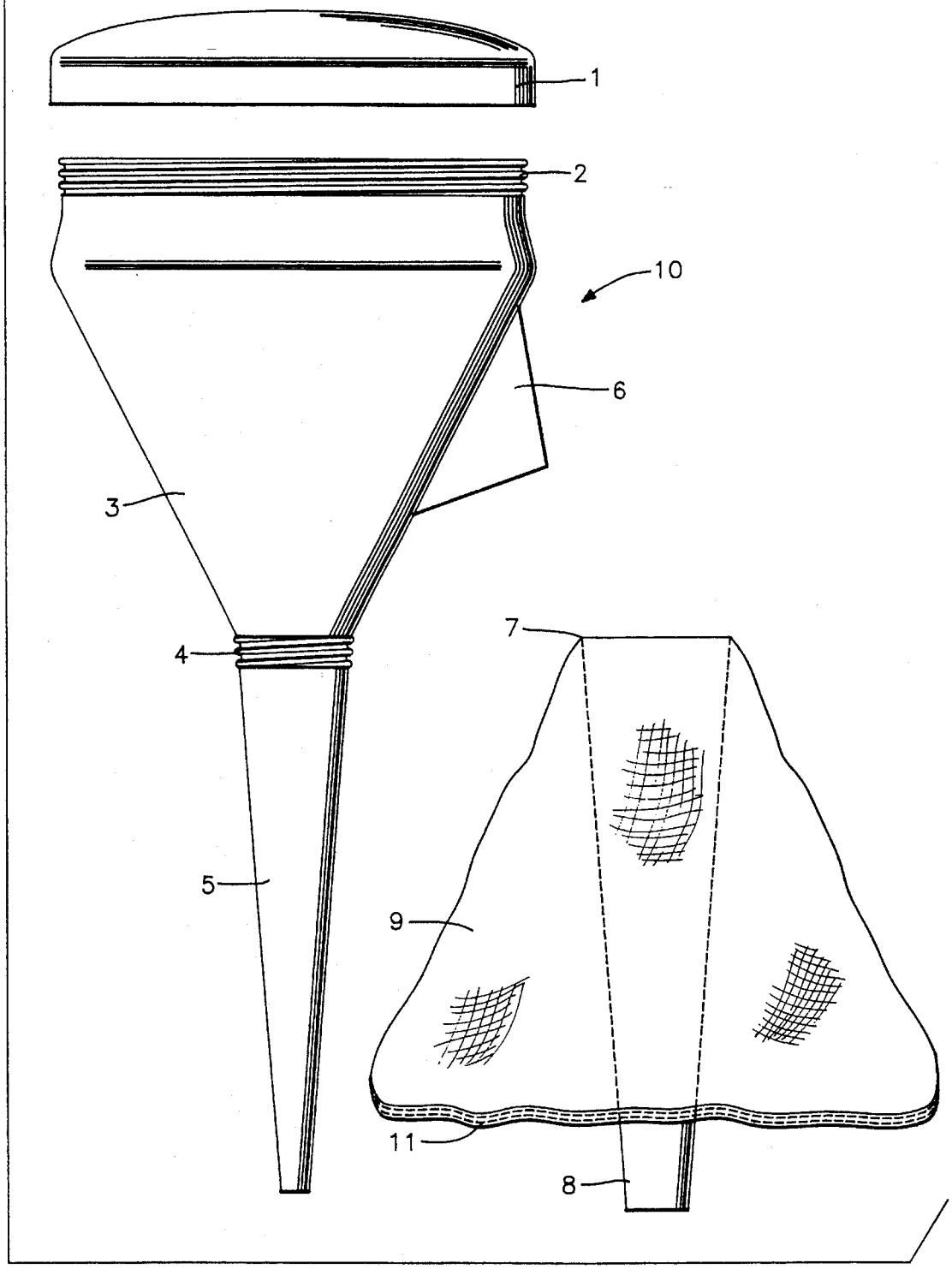
FIGS. 5 and 6 illustrate a preferred embodiment of the present invention wherein a netting material (or bag) is disposed circumferentially around the sleeve.
Figure 6:
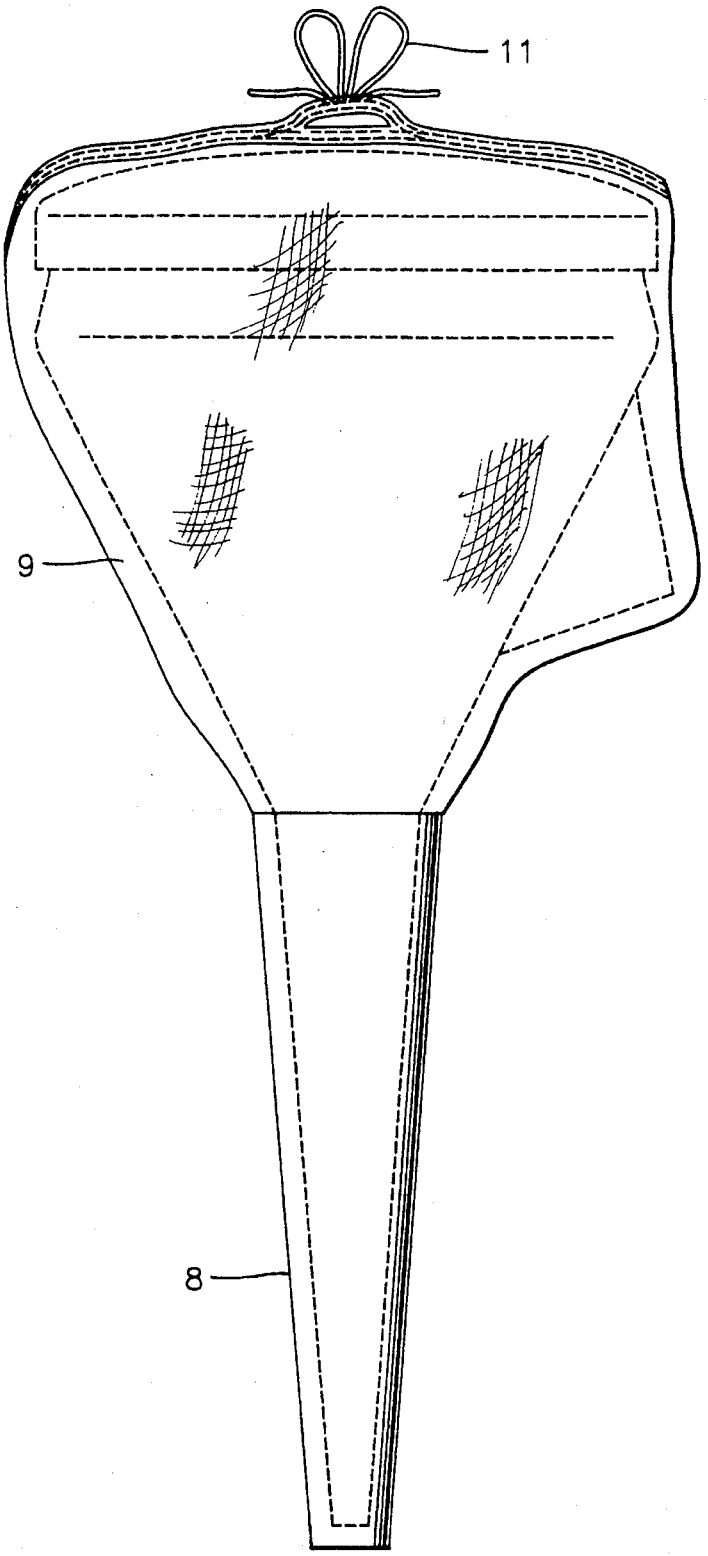

With reference to FIGS. 5 and 6, for added protection, the sleeve 8 preferably includes a netting material (or bag) 9 which is mounted circumferentially around the sleeve 8 and has dimensions sufficiently large enough that the netting material (or bag) 9 can be drawn over and around the progressively narrowing top portion 3 to thereby protect the top portion 3 from contaminants. By using this netting material (or bag) 9 in the foregoing manner, both the inside and outside surface areas of the entire funnel 10 are protected from contaminants.

Preferably, the netting material (or bag) 9 further comprises a drawing means 11 so that the netting material (or bag) 9 can be drawn tightly around the progressively narrowing top portion 3. Illustrative examples of such drawing means include draw strings, elastic bands, and hook-and-loop fasteners commonly known as "VELCRO".

Figure 7:
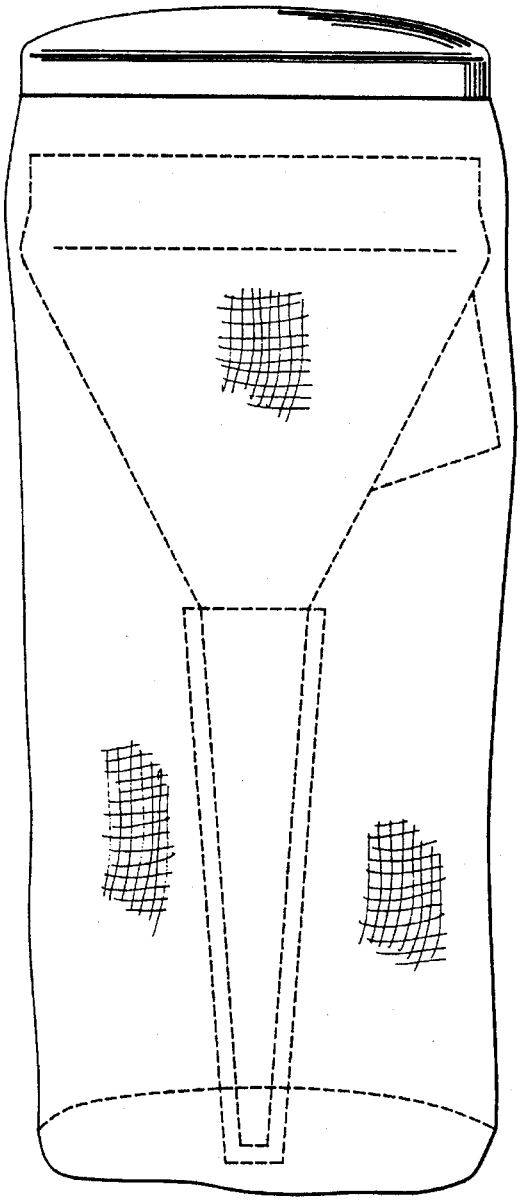
FIG. 7 illustrates another preferred embodiment of the present invention wherein a netting material (or bag) is disposed circumferentially around a cap.
Figure 8:
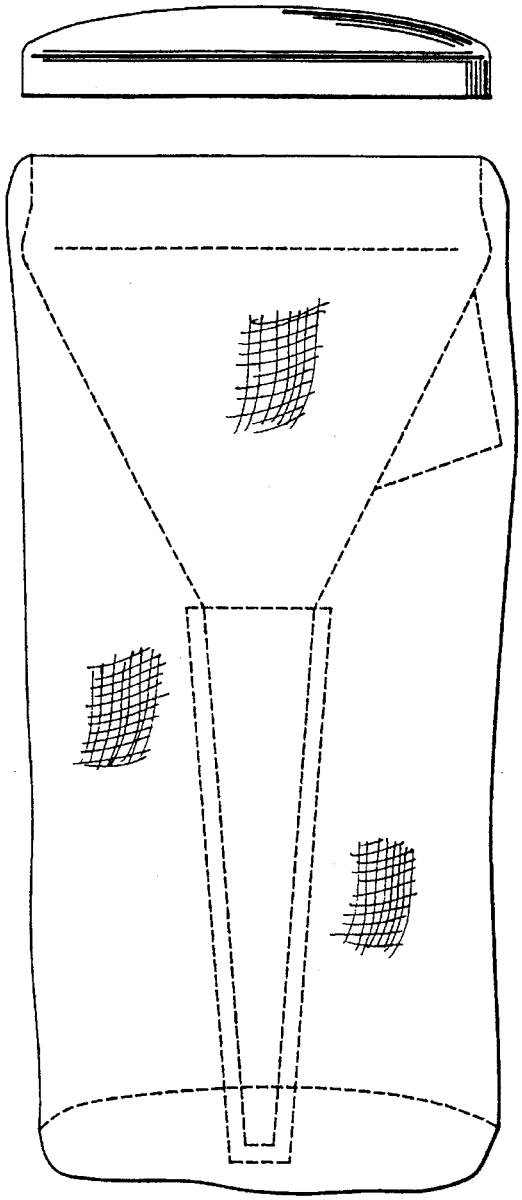
FIG. 8 illustrates yet another preferred embodiment of the present invention wherein a netting material (or bag) is disposed circumferentially around the broad intake end of the funnel.

With reference to FIGS. 7 and 8, respectively, the netting material (or bag) 9, alternatively, can be mounted to the cap 1 or to the broad intake end 2 of the progressively narrowing portion 3. This netting material (or bag) 9 is then connected circumferentially around the sleeve 8, or alternatively, drawn completely around the spout 5 and sleeve 8 so as to protect the exterior of the progressively narrowing portion from contaminants. In the latter case (which is illustrated), the exterior of the sleeve 8 is also protected.

The funnel and sleeve can be manufactured using any suitable material, including plastic, aluminum, tin, and copper. Likewise, the shape and size of the funnel can be modified according to the desired use of the funnel. For example, the funnel can be shaped and sized to fit an opening in a small twocycle engine, or smaller and larger openings as needed.

While the present invention has been described with reference to the foregoing preferred embodiments, it is understood that the invention is not limited to these embodiments, but is instead limited only by the scope of the claims appended hereto.

I claim:

1. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated;

said funnel further comprising a cap for securely engaging and covering the broad intake end of the progressively narrowing top portion and a netting material connectable circumferentially around said cap and having dimensions sufficiently large enough that said netting material can be drawn over and around said progressively narrowing top portion to thereby protect said top portion from contaminants.

2. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated;

said funnel further comprising a cap for securely engaging and covering the broad intake end of the progressively narrowing top portion and a bag connectable circumferentially around said cap and having dimensions sufficiently large enough that said bag can be drawn over and around said progressively narrowing top portion to thereby protect said top portion from contaminants.

3. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated;

said funnel further comprising a cap for securely engaging and covering the broad intake end of the progressively narrowing top portion and attachment means for attaching said cap to the funnel to prevent said cap from being entirely removed from the funnel and inadvertently misplaced.

4. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated and further comprising a netting material connectable circumferentially around said sleeve and having dimensions sufficiently large enough that said netting material can be drawn over and around said progressively narrowing top portion to thereby protect said top portion from contaminants.

5. The funnel of claim 4, wherein said netting material further comprises a draw string threaded through a peripheral portion of said netting material, so that the netting material can be drawn tightly around said progressively narrowing top portion.

6. The funnel of claim 4, wherein said netting material comprises an elastic band disposed about a peripheral portion of said netting material, so that the netting material draws tightly around said progressively narrowing top portion.

7. The funnel of claim 4, wherein said netting material further comprises a hook and loop fastener for drawing the netting material tightly around the progressively narrowing top portion.

8. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated and further comprising a bag connectable circumferentially around said sleeve and having dimensions sufficiently large enough that said bag can be drawn over and around said progressively narrowing top portion to thereby protect said top portion from contaminants.

9. The funnel of claim 8, wherein said bag further comprises a draw string threaded through a peripheral portion of said bag, so that the bag can be drawn tightly around said progressively narrowing top portion.

10. The funnel of claim 8, wherein said bag comprises an elastic band disposed about a peripheral portion of said bag, so that the bag draws tightly around said progressively narrowing top portion.

11. The funnel of claim 8, wherein said bag further comprises a hook-and-loop fastener for drawing the bag tightly around the progressively narrowing top portion.

12. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated and further comprising a netting material connectable circumferentially around said broad intake end and having dimensions sufficiently large enough that said netting material can be drawn over and around said progressively narrowing top portion to thereby protect said top portion from contaminants.

13. A funnel having a progressively narrowing top portion with a broad intake end and a narrow discharge end, and a pouring spout located at the narrow discharge end of said progressively narrowing top portion, said funnel further comprising:

a sleeve adapted to receive said pouring spout and having means for securely engaging said narrow discharge end of the progressively narrowing top portion to thereby cover said pouring spout and prevent the interior and exterior of said pouring spout from becoming contaminated and further comprising a bag connectable circumferentially around said broad intake end and having dimensions sufficiently large enough that said netting material can be drawn over and around said progressively narrowing top portion to thereby protect said top portion from contaminants.

14. A sleeve for covering the pouring spout of a funnel such that the exterior and interior surface areas of the pouring spout are protected from contaminants, said sleeve comprising:

a substantially tubular body adapted to receive the pouring spout of a funnel, said substantially tubular body having a closed distal end and an open proximal end;

means for securely connecting said sleeve to the funnel while the pouring spout of the funnel is contained within said sleeve; and a netting material mounted circumferentially around said sleeve and having dimensions sufficiently large enough that said netting material can be drawn over and around any portion of the funnel which is not contained within said sleeve.

15. The sleeve of claim 14, wherein said netting material further comprises means for drawing said netting material tightly around any portion of the funnel not contained within said sleeve.

16. A sleeve for covering the pouring spout of a funnel such that the exterior and interior surface areas of thepouring spout are protected from contaminants, said sleeve comprising:

a substantially tubular body adapted to receive the pouring spout of a funnel, said substantially tubular body having a closed distal end and an open proximal end;

means for securely connecting said sleeve to the funnel while the pouring spout of the funnel is contained within said sleeve; and a bag mounted circumferentially around said sleeve and having dimensions sufficiently large enough that said bag can be drawn over and around any portion of the funnel which is not contained within said sleeve.

17. The sleeve of claim 16, wherein said bag further comprises means for drawing said bag tightly around any portion of the funnel not contained within said sleeve.

* * * * *